US009024984B2

(12) United States Patent
Akatsuka et al.

(10) Patent No.: US 9,024,984 B2
(45) Date of Patent: May 5, 2015

(54) SHEET FEEDER AND IMAGE FORMING APPARATUS

(71) Applicant: Canon Kabushiki Kaisha, Tokyo (JP)

(72) Inventors: Junya Akatsuka, Kawasaki (JP); Daisuke Aoki, Yokohama (JP); Atsushi Murakami, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 7 days.

(21) Appl. No.: 13/710,768

(22) Filed: Dec. 11, 2012

(65) Prior Publication Data

US 2013/0222505 A1 Aug. 29, 2013

(30) Foreign Application Priority Data

Feb. 29, 2012 (JP) ..... 2012-044512

(51) Int. Cl.

| | |
|---|---|
| ***B65H 1/00*** | (2006.01) |
| ***B41J 11/00*** | (2006.01) |
| ***B65H 1/26*** | (2006.01) |
| ***B65H 3/06*** | (2006.01) |
| ***B65H 7/02*** | (2006.01) |

(52) U.S. Cl.

CPC ..... *B41J 11/0095* (2013.01); *B65H 1/00* (2013.01); *B65H 1/266* (2013.01); *B65H 3/0607* (2013.01); *B65H 7/02* (2013.01); *B65H 2511/152* (2013.01); *B65H 2511/514* (2013.01); *B65H 2513/511* (2013.01); *B65H 2513/53* (2013.01); *B65H 2553/612* (2013.01); *B65H 2601/523* (2013.01); *B65H 2801/12* (2013.01)

(58) Field of Classification Search

CPC ..... B65H 2511/152; B65H 2511/15; B65H 2511/13; B65H 2301/42324; B65H 2301/423245; B65H 2511/30; B65H 1/00; B41J 11/0095

USPC ..... 347/5, 9, 14, 101, 104; 271/147

See application file for complete search history.

(56) References Cited

U.S. PATENT DOCUMENTS

| | | | | |
|---|---|---|---|---|
| 6,994,341 | B2 | 2/2006 | Aoki et al. | |
| 2010/0054801 | A1 * | 3/2010 | Kitamura et al. | 399/114 |
| 2010/0322689 | A1 * | 12/2010 | Ohtani et al. | 399/388 |

FOREIGN PATENT DOCUMENTS

JP H06-179544 A 6/1994

* cited by examiner

*Primary Examiner* — Geoffrey Mruk
*Assistant Examiner* — Scott A Richmond
(74) *Attorney, Agent, or Firm* — Fitzpatrick, Cella, Harper & Scinto

(57) ABSTRACT

The present invention provides a sheet feeder, including: a support member which can be rotated around a pivot at upstream side thereof in a sheet feeding direction and supports sheets; a driving unit rotating the support member upwardly; a feeding portion feeding the sheets; a first detection unit detecting the sheets on the support member at a first detection position above the support member; a second detection unit detecting the sheets on the support member at a second detection position located at upstream of the first detection position and below the first detection position; and a stacking amount determining portion determining a stacking amount of the sheets on the support member, based on a period of time between a time when the second detection unit detects the sheets and a time when the first detection unit detects the sheets while the support member is upwardly rotated by the driving unit.

13 Claims, 9 Drawing Sheets

SHEET FEEDER AND IMAGE FORMING APPARATUS

BACKGROUND OF THE INVENTION

1. Field of the Invention

The present invention relates to a sheet feeder and an image forming apparatus, and more particularly, to a sheet feeder which can detect the stacking amount of sheets contained in the sheet feeder, and an image forming apparatus including the same.

2. Description of the Related Art

Conventionally, in an image forming apparatus such as a printer, a facsimile machine, or a copying machine, there has been known a method of detecting that the amount of sheets stacked in a stacking tray becomes smaller using the rotation position of an intermediate plate which raises the sheets (Japanese Patent Application Laid-Open No. H06-179544).

In an image forming apparatus, for example, sheets are pushed up by rotating an intermediate plate which is rotatably supported by a stacking tray, and first, the presence or absence of sheets stacked on the intermediate plate is detected by a sheet presence or absence detection sensor. When there is no sheet, the image forming apparatus ends feeding operation. When sheets are stacked, the upper surface of the sheets is detected by an upper surface detection sensor so that the sheets which are pushed up are kept at a predetermined height. Further, a remaining amount detection sensor detects the stacking amount of the sheets based on the rotation position of the intermediate plate or the like.

In the conventional image forming apparatus, in detecting the stacking amount of the sheets stacked in the stacking tray, the three sensors, that is, the sheet presence or absence detection sensor, the upper surface detection sensor, and the remaining amount detection sensor are required. Therefore, space for the sheet presence or absence detection sensor, the upper surface detection sensor, and the remaining amount detection sensor is necessary, which inhibits downsizing of the image forming apparatus that is desired these days, and also, the need for the three sensors inhibits cost reduction of the image forming apparatus.

SUMMARY OF THE INVENTION

The present invention provides a sheet feeder which enables space saving and cost reduction by eliminating a remaining amount detection sensor, and provides an image forming apparatus including the same.

The present invention provides, as an example, a sheet feeder, including: a support member which can be rotated around a pivot at upstream side thereof in a sheet feeding direction and supports sheets; a driving unit which rotates the support member upwardly; a feeding portion which feeds the sheets on the support member; a first detection unit which detects the sheets on the support member at a first detection position above the support member; a second detection unit which detects the sheets on the support member at a second detection position located at upstream of the first detection position in the sheet feeding direction and below the first detection position; and a stacking amount determining portion determining a stacking amount of the sheets on the support member, based on a period of time between a time when the second detection unit detects the sheets and a time when the first detection unit detects the sheets while the support member is upwardly rotated by the driving unit.

The present invention provides, as another example, an image forming apparatus, including: a support member which can be rotated around a pivot at upstream side thereof in a sheet feeding direction and supports sheets; a driving unit which rotates the support member upwardly; a feeding portion which feeds the sheets on the support member; an image forming portion forming an image on the sheets which are fed by the feeding portion; a first detection unit which detects the sheets on the support member at a first detection position above the support member; a second detection unit which detects the sheets on the support member at a second detection position located at upstream of the first detection position in the sheet feeding direction and below the first detection position; and a stacking amount determining portion determining a stacking amount of the sheets on the support member, based on a period of time between a time when the second detection unit detects the sheets and a time when the first detection unit detects the sheets while the support member is upwardly rotated by the driving unit.

According to the present invention, space saving and cost reduction can be accomplished by eliminating a sensor.

Further features of the present invention will become apparent from the following description of exemplary embodiments with reference to the attached drawings.

DESCRIPTION OF THE EMBODIMENTS

An image forming apparatus including a sheet feeder according to an embodiment of the present invention will now be described in the following with reference to the attached drawings. The image forming apparatus according to the embodiment of the present invention is an image forming apparatus including a sheet feeder which can detect the stacking amount of contained sheets, such as a copying machine, a printer, a facsimile machine, or a multifunction peripheral thereof. In the following description of the embodiment, a laser beam printer (hereinafter simply referred to as "laser printer") 1 which forms a toner image of four colors is used.

Figure 1:
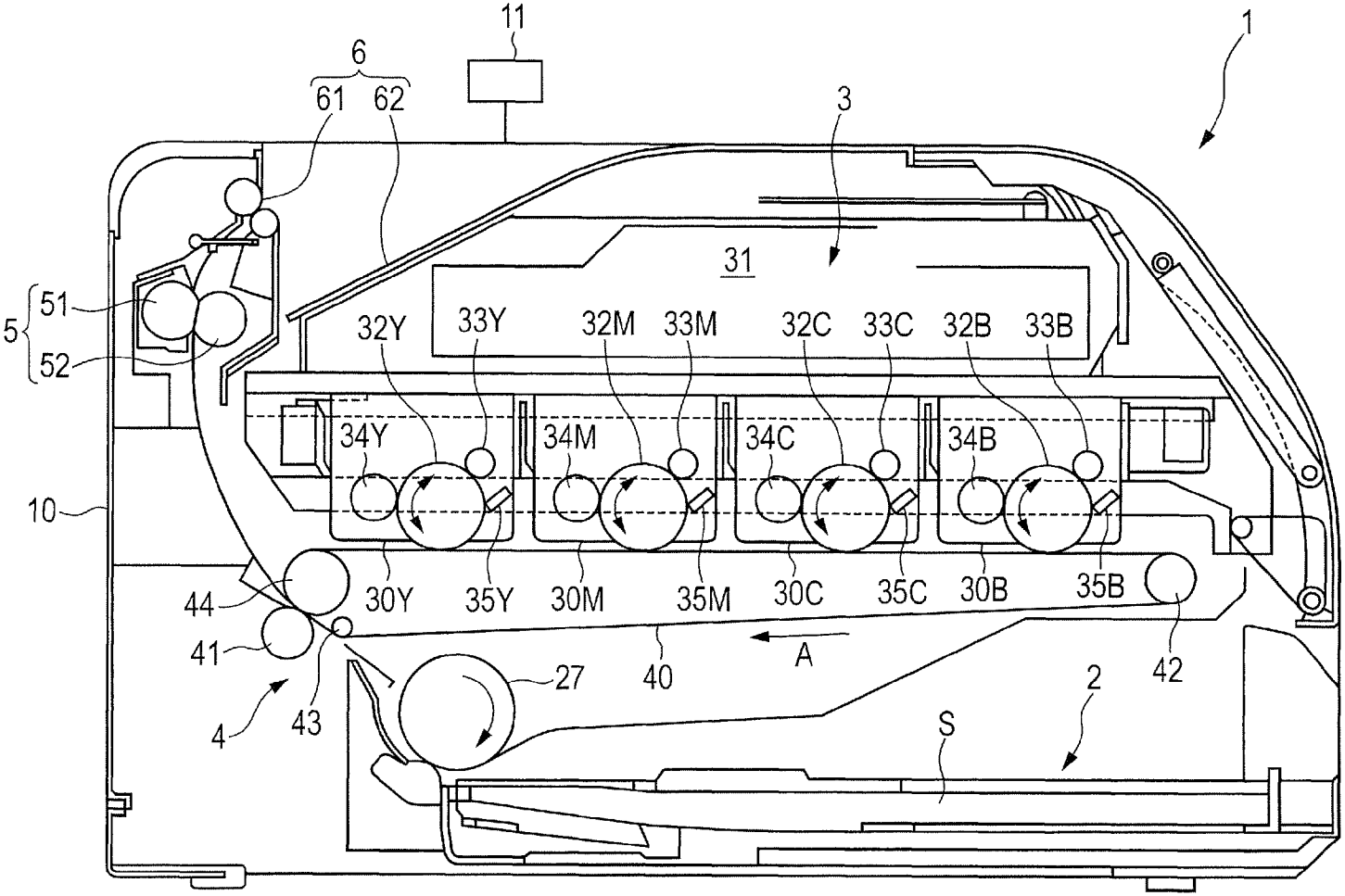
FIG. 1 is a schematic sectional view illustrating an overall structure of a laser printer according to an embodiment.
Figure 2:
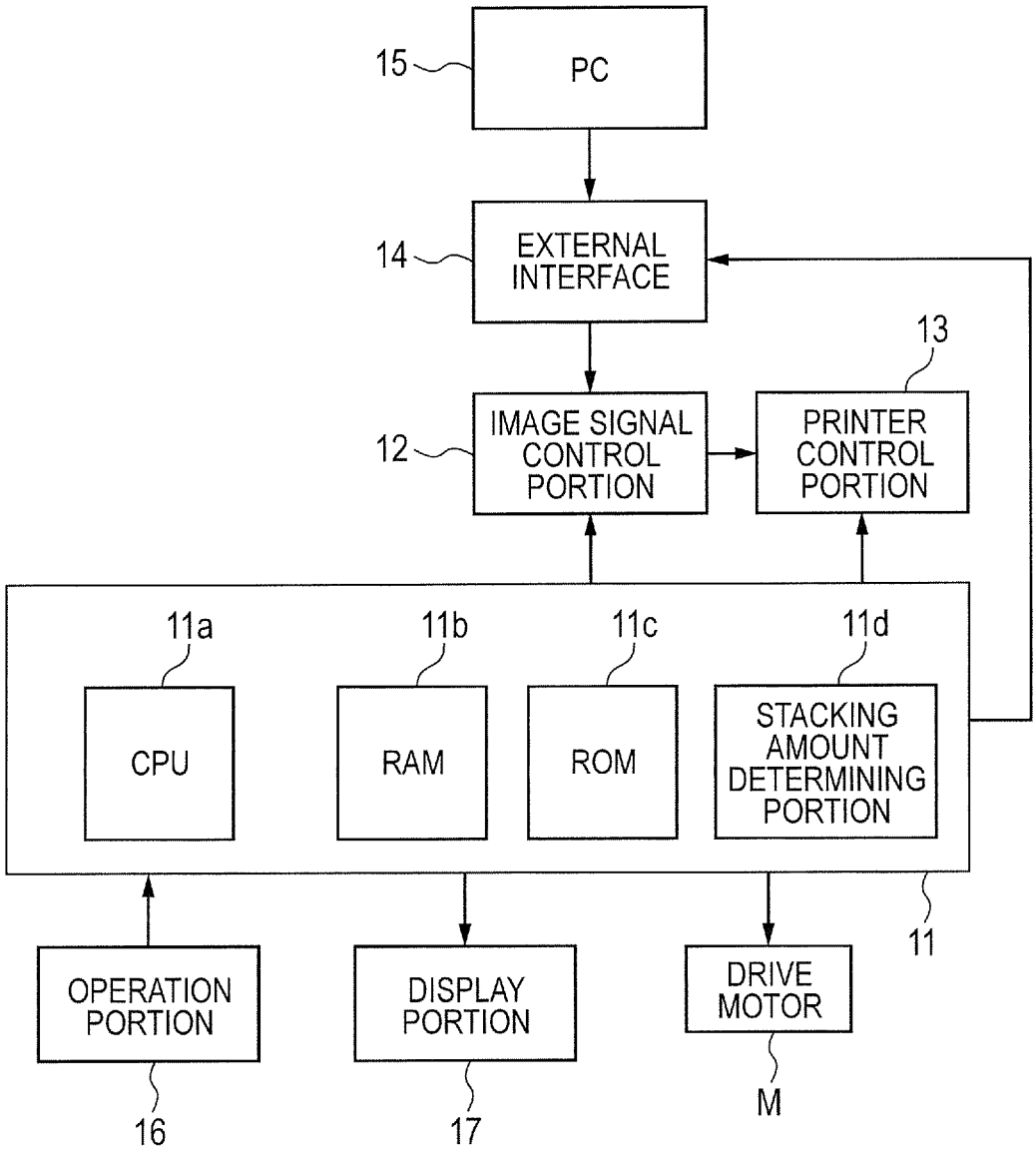
FIG. 2 is a block diagram illustrating a control portion for controlling the laser printer according to the embodiment.

A structure of the laser printer 1 according to the embodiment of the present invention is described with reference to FIG. 1 and FIG. 2. FIG. 1 is a schematic sectional view illustrating the overall structure of the laser printer 1 according to the embodiment of the present invention. FIG. 2 is a block diagram illustrating a control portion 11 for controlling the laser printer 1 according to the embodiment.

As illustrated in FIG. 1, the laser printer 1 according to the embodiment includes a sheet feeder 2 for feeding sheets S, an image forming portion 3 for forming an image on the sheets S, and a transfer portion 4 for transferring an image formed in the image forming portion 3 onto the sheets S. The laser printer 1 further includes a fixing portion 5 for fixing an image transferred in the transfer portion 4 onto the sheets S, a discharge portion 6 for discharging the sheets S onto which an image is fixed in the fixing portion 5, and the control portion 11. The sheet feeder 2 is provided in a lower portion of the laser printer 1 and feeds the sheets S one by one. The sheet feeder 2 is described in detail later.

The image forming portion 3 is provided above the sheet feeder 2, and includes process cartridges 30Y, 30M, 30C, and 30B for forming images of four colors: yellow (Y); magenta (M); cyan (C); and black (B), respectively, and an exposure unit 31. The process cartridges 30Y to 30B have the same structure except that the colors of images to be formed therewith are different. Therefore, in the following, only the structure of the process cartridge 30Y for forming a yellow (Y) image is described and description of the process cartridges 30M to 30B is omitted.

The process cartridge 30Y includes a photosensitive drum 32Y which is driven to rotate by a drive motor (not shown), a charging roller 33Y for uniformly charging the surface of the photosensitive drum 32Y, and a developing roller 34Y for developing a yellow electrostatic latent image using yellow toner. The process cartridge 30Y further includes a cleaning member 35Y for removing residual toner. The process cartridge 30Y is integrally constituted as a cartridge including the photosensitive drum 32Y, the charging roller 33Y, the developing roller 34Y, and the cleaning member 35Y, and is detachable from a printer body 10 of the laser printer 1.

The transfer portion 4 includes an endless intermediate transfer belt 40, multiple primary transfer rollers (not shown), and a secondary transfer roller 41. The intermediate transfer belt 40 is looped around a drive roller 42, a driven roller 43, and a secondary transfer opposing roller 44 so as to be in abutment on all the photosensitive drums 32Y to 32B, and is rotated in a direction of an arrow A in FIG. 1. The multiple primary transfer rollers are provided on an inner peripheral surface side of the intermediate transfer belt 40 so as to be opposed to the photosensitive drums 32Y to 32B, respectively. The multiple primary transfer rollers form a primary transfer portion by being in pressure contact with the photosensitive drums 32Y to 32B, respectively, through an intermediation of the intermediate transfer belt 40. The secondary transfer roller 41 is provided so as to be opposed to the secondary transfer opposing roller 44, and forms a secondary transfer portion by being in pressure contact with the secondary transfer opposing roller 44 through an intermediation of the intermediate transfer belt 40.

The fixing portion 5 is provided downstream from the secondary transfer portion, and includes a fixing roller 51 having a built-in heater and a pressure roller 52 in pressure contact with the fixing roller 51. The discharge portion 6 is provided downstream from the fixing portion 5, and includes a discharge roller pair 61 for discharging the sheets S to the outside of the apparatus and a discharge tray 62 for stacking thereon the sheets S discharged to the outside of the apparatus.

As illustrated in FIG. 2, the control portion 11 is electrically connected to and can control an image signal control portion 12 connected to an external interface 14, a printer control portion 13, a display portion 17, and the like. Further, the control portion 11 includes a CPU 11*a*, a RAM 11*b*, a ROM 11*c*, and a stacking amount determining portion 11*d*. The CPU 11*a* executes various kinds of programs stored in the ROM 11*c* using the RAM 11*b* in accordance with setting by an operation portion 16 and the like and controls the printer control portion 13 and the like. Further, the CPU 11*a* causes the stacking amount determining portion 11*d* to determine the stacking amount of the sheets S stacked on a stacking tray 20, and causes the display portion 17 to display the stacking amount determined by the stacking amount determining portion 11*d*. A method of determining the sheet stacking amount by the stacking amount determining portion 11*d* is described later.

The external interface 14 is an interface for implementing a network printer and the like, and converts print data, which is input from a connected PC 15 or the like, into image information and outputs the image information to the image signal control portion 12. The image signal control portion 12 outputs to the printer control portion 13 the image information which is input via the external interface 14. The printer control portion 13 carries out image formation processing to be described later based on the image information which is input from the image signal control portion 12.

Next, an image forming job by the control portion 11 of the laser printer 1 according to the embodiment is described. When the image forming job is started, in accordance with the setting by the operation portion 16 and based on the image information which is input from the PC 15 or the like, the exposure unit 31 irradiates laser light in accordance with image signals for yellow color of the image information to the photosensitive drum 32Y which is uniformly charged by the charging roller 33Y. Accordingly, a yellow electrostatic latent image is formed on the photosensitive drum 32Y.

Next, the yellow electrostatic latent image is developed and visualized on the developing roller 34Y with contained yellow toner and the yellow toner image is primarily transferred onto the intermediate transfer belt 40 with the primary transfer roller. Similarly to the above-mentioned method, magenta, cyan, and black toner images are visualized on the surfaces of the photosensitive drums 32M to 32B, respectively, and are transferred onto the intermediate transfer belt 40 in succession so as to be superimposed on the yellow toner image. Accordingly, a full color toner image is primarily transferred onto the intermediate transfer belt 40.

In parallel with the toner image forming operation, the sheets S contained in the sheet feeder 2 are separated one by one and fed to the secondary transfer portion located on the downstream side, and the full color toner image on the intermediate transfer belt 40 is secondarily transferred in the secondary transfer portion. The sheet S having the toner image secondarily transferred thereto is subject to heat and pressure in the fixing portion 5, thereby fixing thereto the full color image. The sheet S is then discharged to the discharge tray 62 by the discharge roller pair 61 provided downstream from the fixing portion 5. Accordingly, the image forming job is ended.

Figure 3:
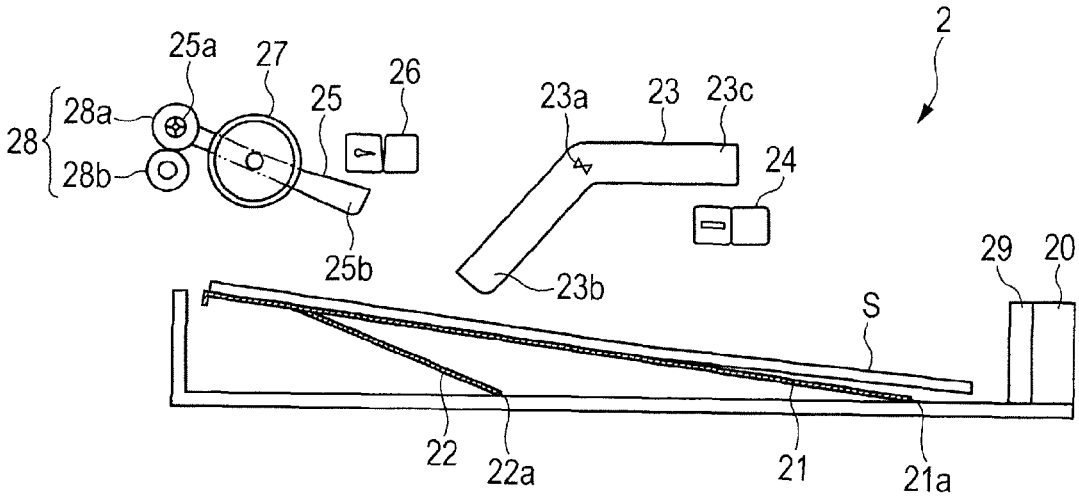
FIG. 3 is a schematic sectional view illustrating a sheet feeder according to the embodiment.

Next, the sheet feeder 2 of the laser printer 1 according to the embodiment is described with reference to FIG. 3 to FIG. 12. First, the structure of the sheet feeder 2 is described with reference to FIG. 3. FIG. 3 is a schematic sectional view illustrating the sheet feeder 2 according to the embodiment.

As illustrated in FIG. 3, the sheet feeder 2 includes the stacking tray 20 for stacking the sheets S therein, an intermediate plate 21 as a support member rotatably supported by the stacking tray 20, and a rotation lever 22 as a driving unit for rotating the intermediate plate 21. The sheet feeder 2 further includes an upper surface detection lever 25 and an upper surface detection sensor 26 as a first detection unit, a sheet presence or absence detection lever 23 and a sheet presence or absence detection sensor 24 as a second detection unit, and a pickup roller 27 for picking up the sheets S. The sheet feeder 2 further includes a separating and feeding portion 28 for separating and feeding the sheets S one by one.

The stacking tray 20 is detachable from the printer body 10, and can be, for example, when the stacking tray 20 becomes short of the sheets S, drawn out of the printer body 10 to be refilled. An end fence 29 is provided at an end of the stacking tray 20 on an upstream side in a sheet feeding direction (hereinafter simply referred to as "on the upstream side"). The end fence 29 regulates trailing ends of the sheets S stacked in the stacking tray 20 to position the sheets S in accordance with the size thereof.

The intermediate plate 21 supports the stacked sheets. A proximal end of the intermediate plate 21 is rotatably supported by the stacking tray 20 about a rotation axis 21*a* as a pivot of the rotation on the upstream side in the stacking tray 20. The intermediate plate 21 is formed so that a downstream end in the sheet feeding direction of the sheets S stacked in the stacking tray 20 can be raised and lowered. Further, the intermediate plate 21 is provided with an opening 21*b* (see FIG. 4 to be referred to later) through which an abutment portion 23*b* of the sheet presence or absence detection lever 23 can pass. When the sheets S are absent on the intermediate plate 21, the abutment portion 23*b* is allowed to pass through the opening 21*b*.

A proximal end of the rotation lever 22 is rotatably supported by the stacking tray 20 about a rotation axis 22*a*. A distal end of the rotation lever 22 is slidably engaged with a lower surface of the intermediate plate 21 on a downstream side in the sheet feeding direction (hereinafter simply referred to as "on the downstream side"). Further, a drive motor M (see FIG. 2) is connected to the rotation axis 22*a* of the rotation lever 22 via a gear mechanism or the like (not shown), and rotation of the rotation axis 22*a* caused by rotation of the drive motor M in turn rotates the rotation lever 22.

A proximal end of the upper surface detection lever 25 is rotatably supported by the printer body 10 about a rotation axis 25*a* on the downstream side of the intermediate plate 21 above the intermediate plate 21. A distal end of the upper surface detection lever 25 is provided with a light-shielding portion 25*b* formed so that light can be blocked from reaching the upper surface detection sensor 26. The upper surface detection lever 25 detects the height of the sheets S on the intermediate plate 21 (on the support member) so that the height of the sheets raised by the rotation of the intermediate plate 21 (for example, the height of the upper surface of the sheets) is held at a predetermined level. In the embodiment, the pickup roller 27 is rotatably supported by the upper surface detection lever 25. The pickup roller 27 is raised by being in abutment on the sheets S on the intermediate plate 21 to rotate the upper surface detection lever 25 upward. The upper surface detection sensor 26 is provided in proximity to the light-shielding portion 25*b* of the upper surface detection lever 25, and, when emitted infrared radiation is blocked by the light-shielding portion 25*b* of the upper surface detection lever 25 which rotates upward, sends (detects) a predetermined signal. The upper surface detection lever 25 and the upper surface detection sensor 26 are located so that the upper surface detection lever 25 and the upper surface detection sensor 26 detect the sheet at a first detection position above the intermediate plate 21.

The sheet presence or absence detection lever 23 is provided on the side of the rotation axis 21*a* of the intermediate plate 21 (on the side of the pivot of the rotation) with respect to the upper surface detection lever 25 at a position (lower position) at which the presence or absence of the sheets S on the intermediate plate 21 can be detected earlier than by the upper surface detection lever 25, and detects the presence or absence of the sheets on the intermediate plate 21. The sheet presence or absence detection lever 23 includes the abutment portion 23*b* which can be in abutment on the sheets S on the intermediate plate 21 and a light-shielding portion 23*c* which can block light from reaching the sheet presence or absence detection sensor 24. The sheet presence or absence detection lever 23 is supported by the printer body 10 so that the abutment portion 23*b* and the light-shielding portion 23*c* are rotatable about a rotation axis 23*a*. Further, the sheet presence or absence detection lever 23 is formed into a bent shape so that, when the abutment portion 23*b* is brought into abutment on the sheets S to rotate the sheet presence or absence detection lever 23, the light-shielding portion 23*c* blocks light from reaching the sheet presence or absence detection sensor 24. Forming the sheet presence or absence detection lever 23 into the bent shape enables space saving of the sheet presence or absence detection lever 23 and the sheet presence or absence detection sensor 24. The sheet presence or absence detection sensor 24 is provided in proximity to the light-shielding portion 23*c* of the sheet presence or absence detection lever 23, and, when emitted infrared radiation is blocked by the light-shielding portion 23*c* which rotates, sends a predetermined signal (detects). The sheet presence or absence detection lever 23 and the sheet presence or absence detection sensor 24 are located so that the sheet presence or absence detection lever 23 and the sheet presence or absence detection sensor 24 detect the sheet at a second detection position located at a side of a pivot of rotation of the intermediate plate 21 with respect to the first detection position at which the upper surface detection sensor 26 detects the sheet and below the first detection position.

The pickup roller 27 is in pressure contact with the sheets S on the intermediate plate 21 to feed the sheets S in the sheet feeding direction. The separating and feeding portion 28 is provided downstream from the pickup roller 27, and includes a feed roller 28*a* for feeding the sheets S and a separation roller 28*b* for separating the sheets S one by one.

Next, a method of determining the sheet stacking amount by the stacking amount determining portion 11*d* using the sheet feeder 2 is described with reference to FIG. 4 to FIG. 10. The sheet feeder 2 according to the embodiment determines the stacking amount of the sheets S on the intermediate plate 21 based on the difference in time (the period of the time) between a time when the sheet presence or absence detection sensor 24 detects the sheets S on the intermediate plate 21 (sends a predetermined signal) and a time when the upper surface detection sensor 26 detects the sheets S on the intermediate plate 21 (sends a predetermined signal).

Figure 4:
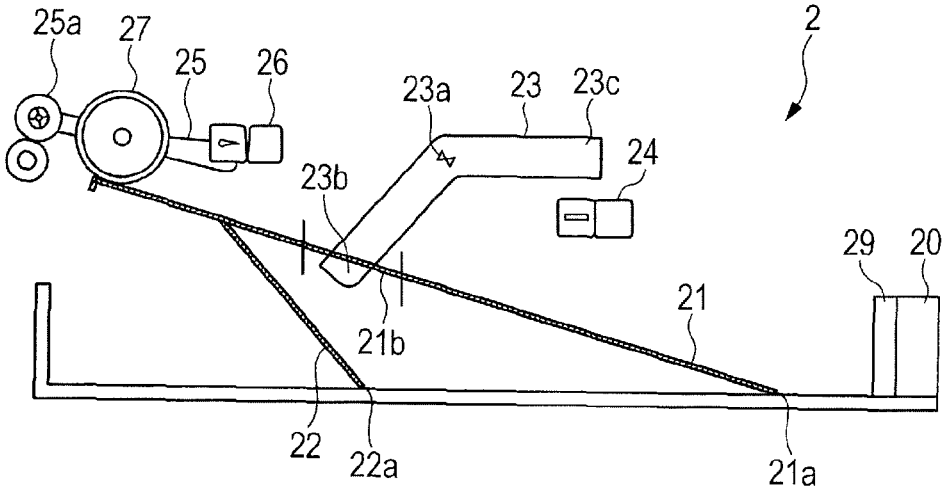
FIG. 4 is a schematic sectional view illustrating the sheet feeder under a state in which no sheet is stacked in a stacking tray.

First, determination of the sheet stacking amount when the sheets S are not stacked in the stacking tray 20 is described with reference to FIG. 4. FIG. 4 is a schematic sectional view illustrating the sheet feeder 2 under a state in which the sheets S are not stacked in the stacking tray 20.

As illustrated in FIG. 4, in a case where the sheets S are not stacked on the intermediate plate 21 of the stacking tray 20, when the intermediate plate 21 rotates, the abutment portion 23*b* of the sheet presence or absence detection lever 23 passes through the opening 21*b* formed in the intermediate plate 21. Therefore, the sheet presence or absence detection lever 23 does not rotate. Accordingly, light is not blocked by the light-shielding portion 23*c* of the sheet presence or absence detection lever 23 from reaching the sheet presence or absence detection sensor 24, and the sheet presence or absence detection sensor 24 does not send a predetermined signal (detect). As a result, when, for example, the upper surface detection sensor 26 sends a predetermined signal under a state in which the sheet presence or absence detection sensor 24 does not send a predetermined signal, it is determined that the sheets S are not present on the intermediate plate 21 (the stacking amount is zero).

Figure 5:
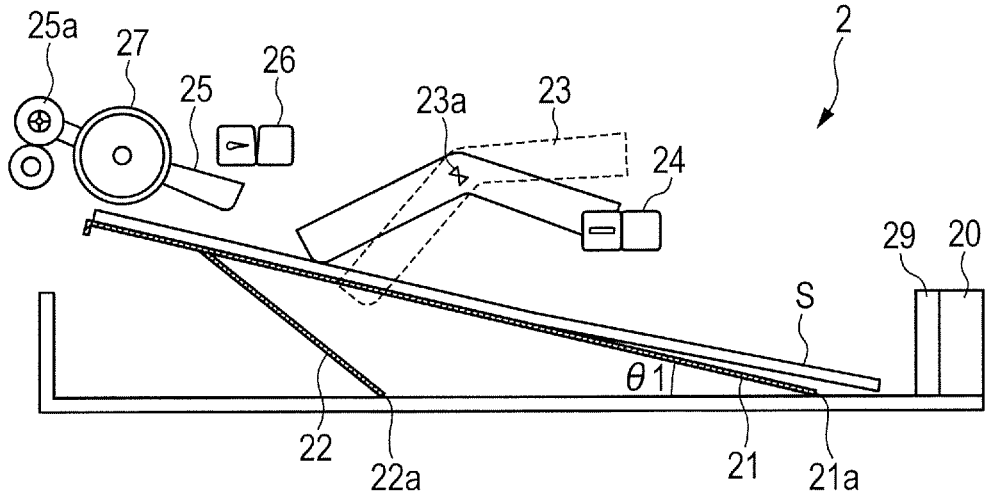
FIG. 5 is a schematic sectional view illustrating a state in which a sheet presence or absence detection sensor detects the presence or absence of sheets when a small amount of sheets is stacked on the stacking tray.
Figure 6:
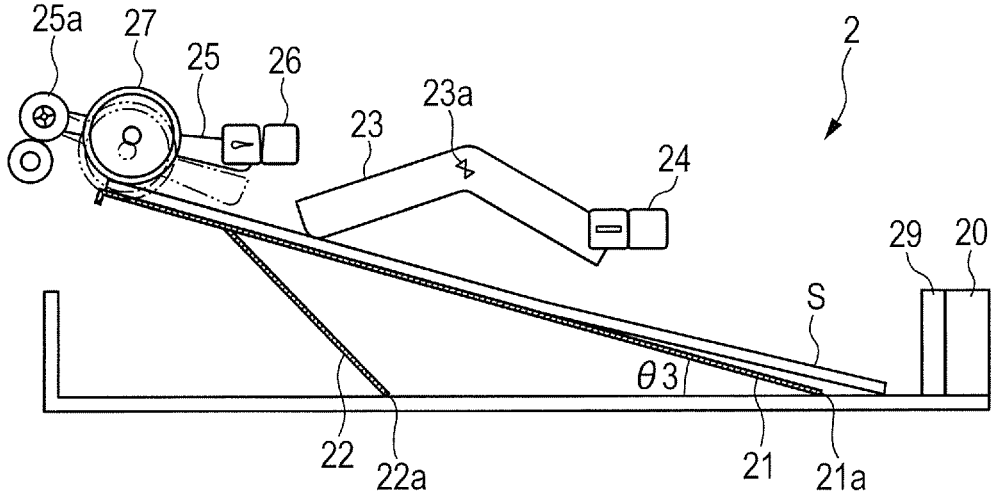
FIG. 6 is a schematic sectional view illustrating a state in which an upper surface detection sensor detects the height of sheets when a small amount of sheets is stacked in the stacking tray.
Figure 7:
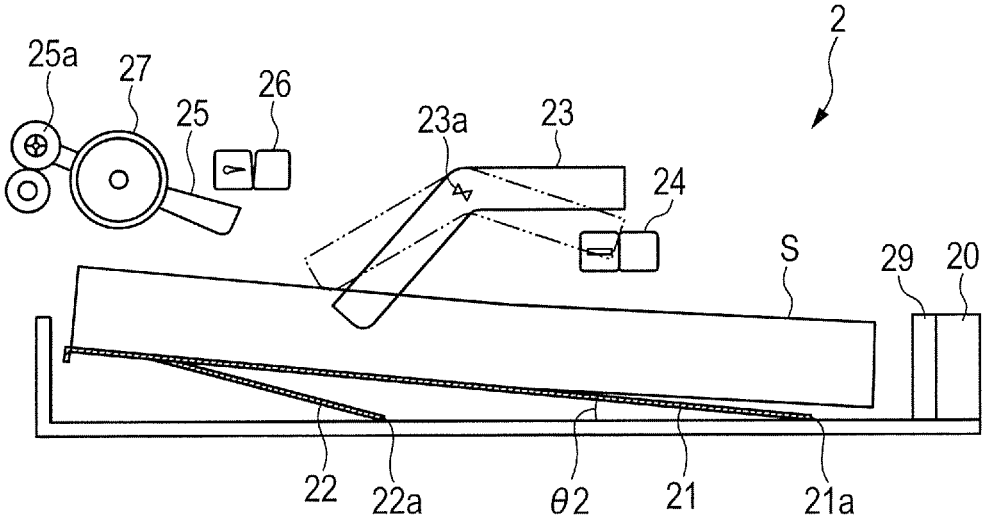
FIG. 7 is a schematic sectional view illustrating a state in which the sheet presence or absence detection sensor detects the presence or absence of sheets when a full amount of sheets is stacked on the stacking tray.
Figure 8:
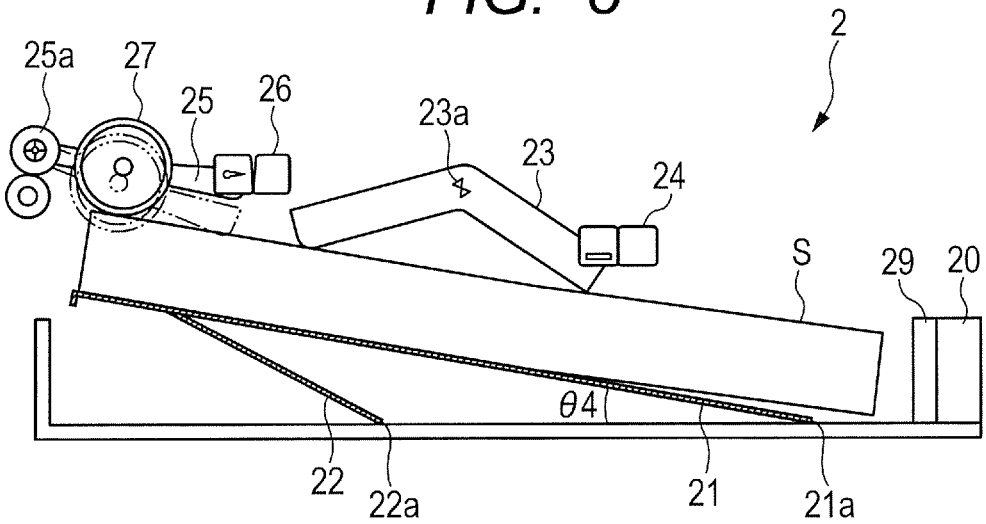
FIG. 8 is a schematic sectional view illustrating a state in which the upper surface detection sensor detects the height of sheets when a full amount of sheets is stacked on the stacking tray.
Figure 9:
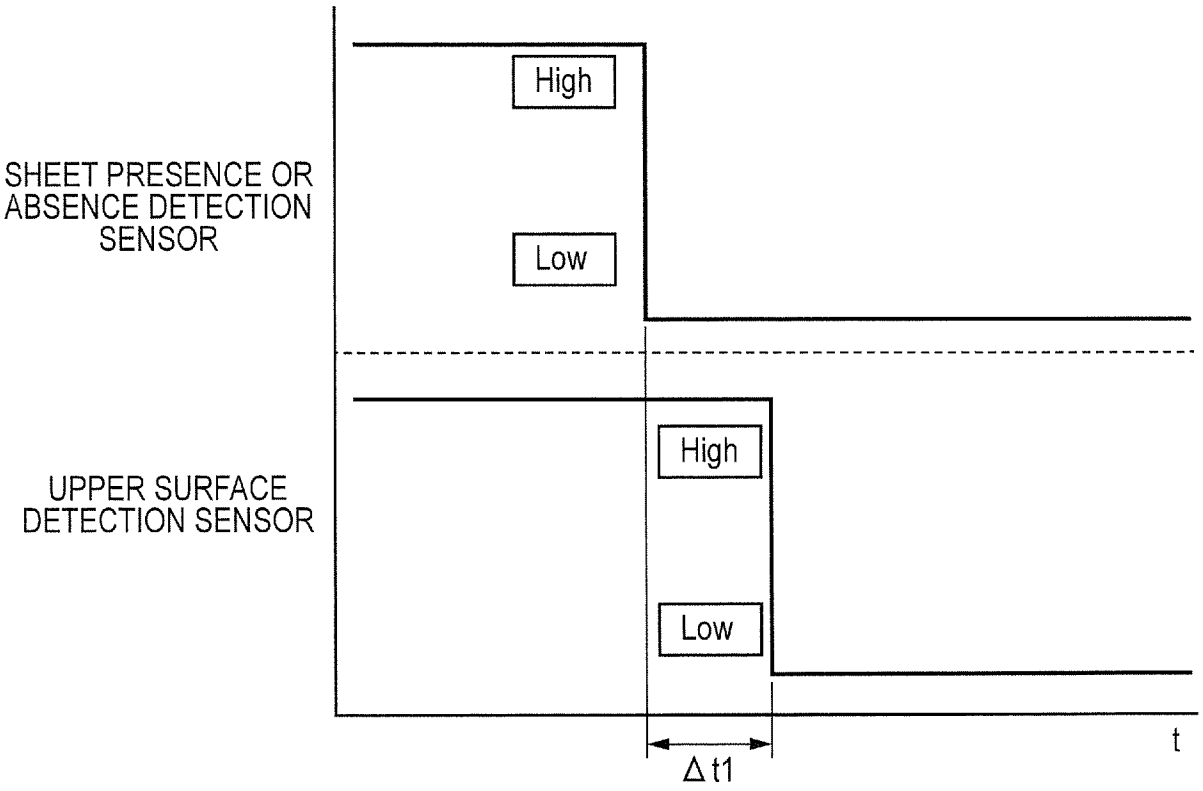
FIG. 9 illustrates detection timing of the sheet presence or absence detection sensor and the upper surface detection sensor when a small amount of sheets is stacked.
Figure 10:
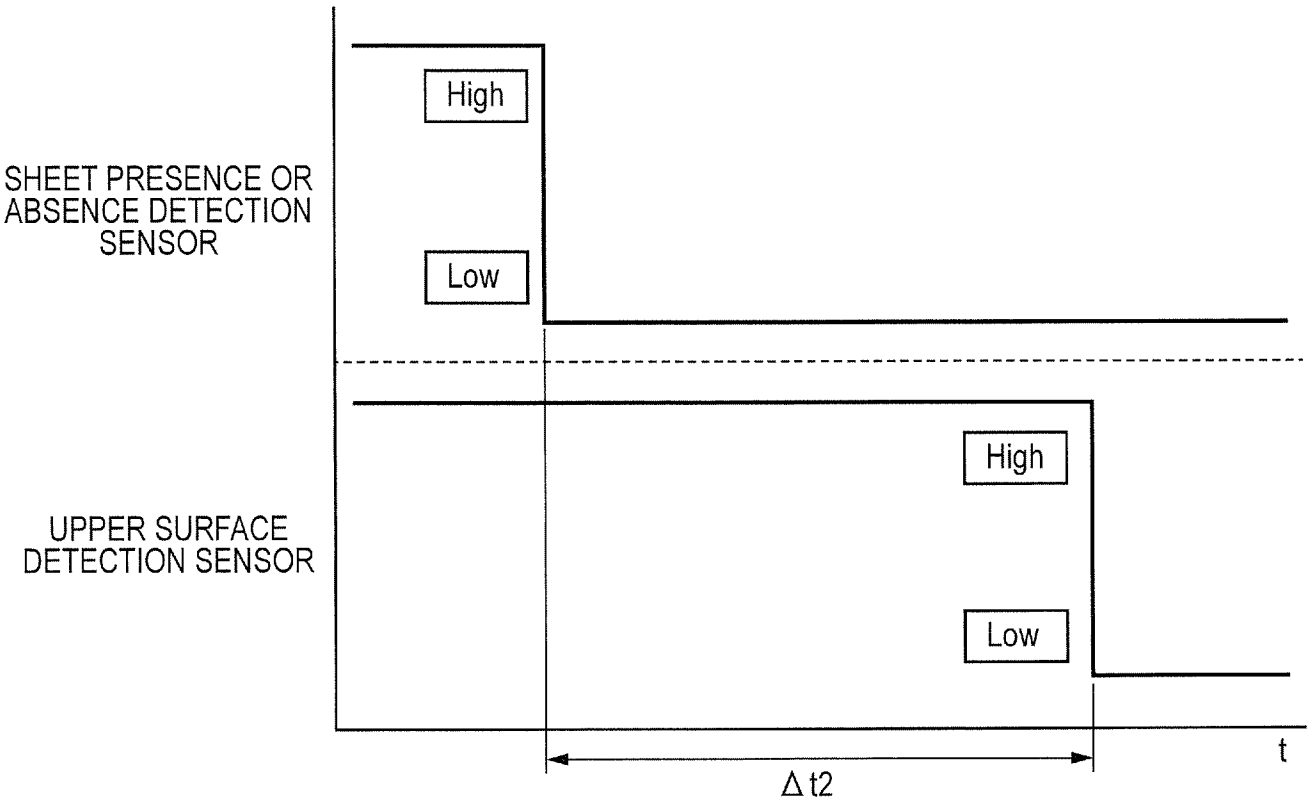
FIG. 10 illustrates detection timing of the sheet presence or absence detection sensor and the upper surface detection sensor when a full amount of sheets is stacked.

Next, difference in detection timing when a small amount of the sheets S is stacked and a full amount of the sheets S is stacked in the stacking tray 20 is described with reference to FIG. 5 to FIG. 10. FIG. 5 is a schematic sectional view illustrating a state in which the sheet presence or absence detection sensor 24 detects the presence or absence of the sheets S when a small amount of the sheets S is stacked in the stacking tray 20. FIG. 6 is a schematic sectional view illustrating a state in which the upper surface detection sensor 26 detects the height of the sheets S on the stacking tray 20 when a small amount of the sheets S is stacked. FIG. 7 is a schematic sectional view illustrating a state in which the sheet presence or absence detection sensor 24 detects the presence or absence of the sheets S on the stacking tray 20 when a full amount of the sheets S is stacked. FIG. 8 is a schematic sectional view illustrating a state in which the upper surface detection sensor 26 detects the height of the sheets S on the stacking tray 20 when a full amount of the sheets S is stacked. FIG. 9 illustrates detection timing of the sheet presence or absence detection sensor 24 and the upper surface detection sensor 26 when a small amount of the sheets S is stacked. FIG. 10 illustrates detection timing of the sheet presence or absence detection sensor 24 and the upper surface detection sensor 26 when a full amount of the sheets S is stacked.

As illustrated in FIG. 5 and FIG. 7, the stacking amount (height) of the sheets on the intermediate plate 21 is different between a case where a small amount of the sheets S is stacked and a case where a full amount of the sheets S is stacked, and thus, the rotation angle of the intermediate plate 21 with respect to the stacking tray 20 differs when the sheet presence or absence detection sensor 24 detects the presence or absence of the sheets S. More specifically, when a small amount of the sheets S is stacked as illustrated in FIG. 5, the height of the sheets S is small, and thus, the rotation amount of the intermediate plate 21 is large when the sheet presence or absence detection sensor 24 detects the sheets S, and, for example, a rotation angle is θ1. On the other hand, when a full amount of the sheets S is stacked as illustrated in FIG. 7, the height of the sheets S is large, and thus, the rotation amount of the intermediate plate 21 is small when the sheet presence or absence detection sensor 24 detects the sheets S, and, for example, a rotation angle is θ2. The relationship between the rotation angle θ1 and the rotation angle θ2 is (rotation angle θ1)>(rotation angle θ2), and thus, when the rotation speed is the same, the presence or absence of the sheets S is detected in a shorter time when a full amount is stacked than when a small amount is stacked as illustrated in FIG. 9 and FIG. 10.

Further, as illustrated in FIG. 6 and FIG. 8, when the upper surface detection sensor 26 detects the upper surface of the sheets S, the rotation angle of the intermediate plate 21 with respect to the stacking tray 20 is different between a case where a small amount of the sheets S is stacked and a case where a full amount of the sheets S is stacked. More specifically, when a small amount of the sheets S is stacked as illustrated in FIG. 6, the rotation amount of the intermediate plate 21 with respect to the stacking tray 20 until the upper surface detection sensor 26 detects the sheets S is, for example, a rotation angle θ3. On the other hand, when a full amount of the sheets S is stacked as illustrated in FIG. 8, the rotation amount of the intermediate plate 21 with respect to the stacking tray 20 until the upper surface detection sensor 26 detects is, for example, a rotation angle θ4. In this case, the rotation angle θ3 is larger than the rotation angle θ4, but the difference in rotation angle (θ4−θ2) is larger than the difference in rotation angle (θ3−θ1). Therefore, after the detection is performed by the sheet presence or absence detection sensor 24, the upper surface of the sheets S is detected in a shorter time when a full amount is stacked than when a small amount is stacked as illustrated in FIG. 9 and FIG. 10. In other words, as illustrated in FIG. 9 and FIG. 10, a difference in time Δt1 when a small amount is stacked is smaller than a difference in time Δt2 when a full amount is stacked. The sheet feeder 2 according to the embodiment determines the stacking amount of the sheets S based on the difference in time.

In general, the weight of the sheets S is higher when a full amount is stacked than when a small amount is stacked, and thus, the rotation speed of the intermediate plate 21 becomes lower, and, as illustrated in FIG. 9 and FIG. 10, a period of time taken before the upper surface detection sensor 26 detects the upper surface of the sheets S becomes longer when a full amount is stacked. However, even when, for example, the setting is performed so that the rotation speed is the same, basically, the difference in time Δt2 is larger than the difference in time Δt1.

Figure 11:
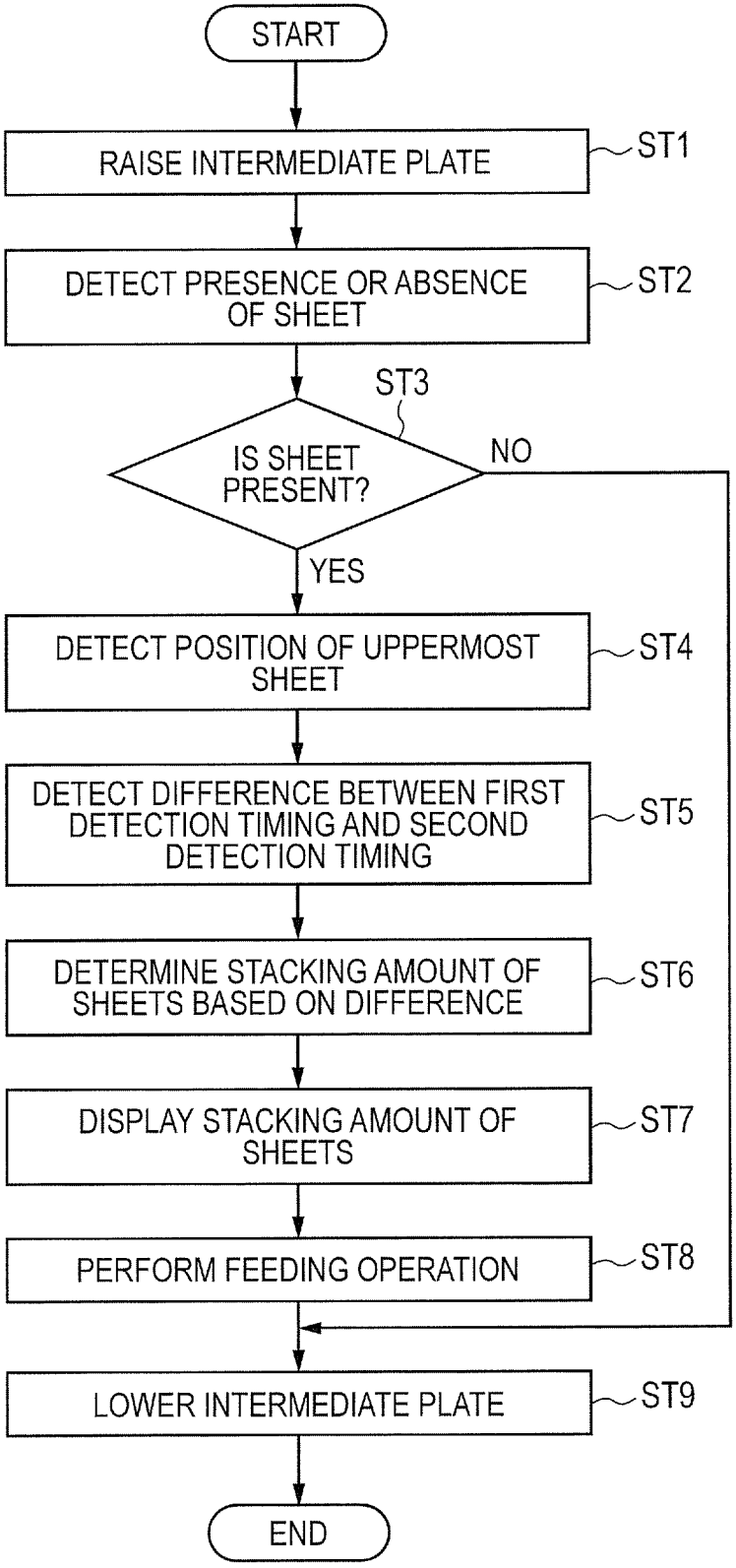
FIG. 11 is a flow chart illustrating a determining operation of the sheet stacking amount by the sheet feeder according to the embodiment.
Figure 12:
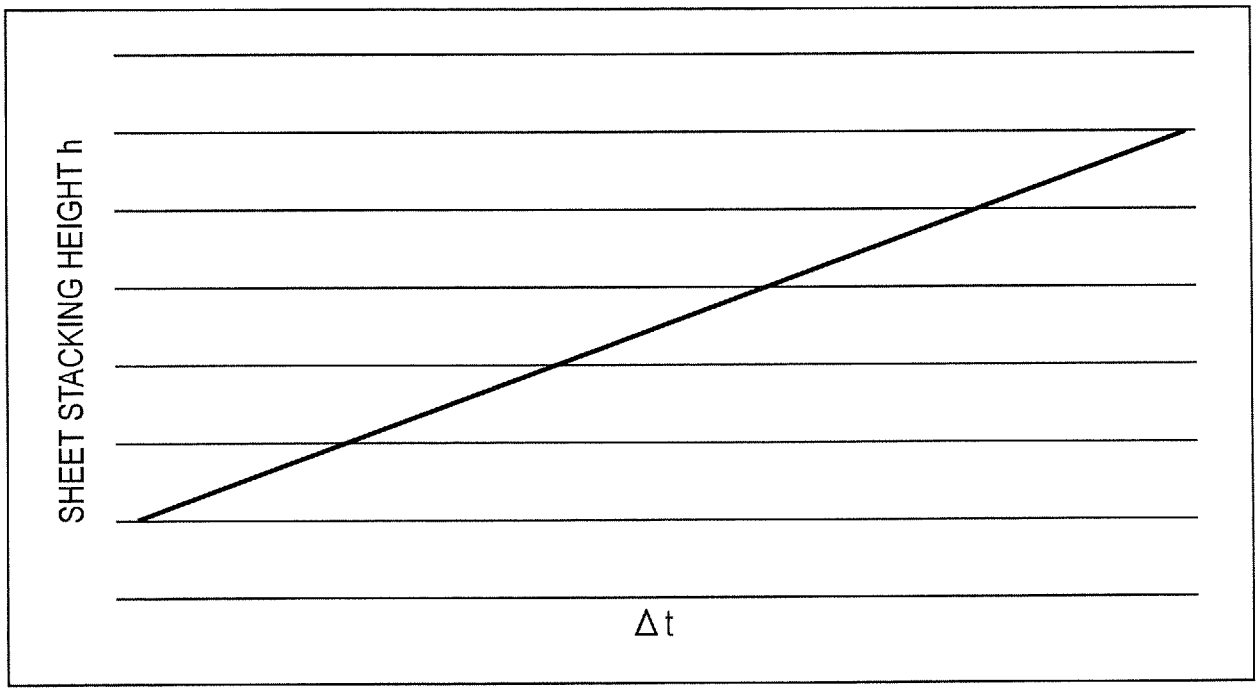
FIG. 12 illustrates a stacking amount determination map in which the relationship between difference in time and sheet stacking amount is recorded in advance.

Next, operation of determining the stacking amount of the sheets S by the sheet feeder 2 based on the determined stacking amount of the sheets S is described with reference to FIG. 11 and FIG. 12. FIG. 11 is a flow chart illustrating operation of determining the sheet stacking amount by the sheet feeder 2 according to the embodiment. FIG. 12 illustrates a stacking amount determination map in which the relationship between difference in time and sheet stacking amount is recorded in advance.

Determination of the stacking amount of the sheets S by the sheet feeder 2 according to the embodiment is performed in synchronization with the above-mentioned operation of feeding the sheets S in the image forming job. As illustrated in FIG. 11, when the operation of feeding the sheets S is started, the intermediate plate 21 is raised (Step ST1), and the sheet presence or absence detection sensor 24 detects the presence or absence of the sheets S while the intermediate plate 21 is raised (Step ST2). When the sheet presence or absence detection sensor 24 detects the absence of the sheets S, the control portion 11 causes the display portion 17 to display an indication that the sheets S are absent, and lowers the intermediate plate 21 (Step ST9) to end the operation of feeding the sheets S.

On the other hand, when the sheet presence or absence detection lever 23 is in abutment on the sheets S and the sheet presence or absence detection sensor 24 detects the presence of the sheets S, then, the upper surface detection sensor 26 detects the height of the sheets S (position of the uppermost sheet) which are raised (Steps ST3 and ST4). Note that, the sheets S on the intermediate plate 21 are kept at a predetermined height through the detection of the uppermost surface thereof by the upper surface detection sensor 26. More specifically, when the amount of the sheets S on the intermediate plate 21 is reduced as the sheets are fed, the upper surface detection sensor 26 no longer detects a sheet. In this case, the intermediate plate 21 is raised until the upper surface detection sensor 26 detects the sheets S. More specifically, based on a signal from the upper surface detection sensor 26, the control portion 11 controls the drive motor which vertically moves the intermediate plate 21 so that the uppermost surface of the sheets on the intermediate plate 21 is in a predetermined range which is appropriate for the feeding.

Next, the control portion 11 causes the stacking amount determining portion 11*d* to detect the difference (difference in time) between a first detection timing (time) at which the sheet presence or absence detection sensor 24 detects the sheets S and a second detection timing (time) at which the upper surface detection sensor 26 detects the sheets S (Step ST5). When the stacking amount determining portion 11*d* detects the difference in time, based on the detected difference in time, the stacking amount determining portion 11*d* determines the stacking amount of the sheets S (Step ST6). In the embodiment, ROM 11*c* (see FIG. 2) stores the data according to the relationship between the difference in time $\Delta t$ and the stacking amount of the sheets S. The stacking amount determining portion 11*d* determines the stacking amount of the sheets S based on the data stored in the ROM 11*c*. As the stacking amount determination map illustrated in FIG. 12, the stacking amount (stacking height h) of the sheets S is proportional to the difference in time ($\Delta t$), and thus, the determination can be performed easily.

When the determination of the stacking amount by the stacking amount determining portion 11*d* is ended, the control portion 11 displays the stacking amount of the sheets S on the display portion 17 (Step ST7), and drives the pickup roller 27 and the feed roller 28*a* to feed the sheets S (Step ST8). When feeding of the sheets S is ended, the control portion 11 lowers the intermediate plate 21 (Step ST9) and ends the operation of feeding the sheets S.

During a period in which the sheets are fed in succession, if the sheet presence or absence detection sensor 24 enters a state of not sending a predetermined signal indicating the presence of the sheets on the intermediate plate 21, the control portion 11 determines that the sheets S are not present on the intermediate plate 21 (the stacking amount is zero).

As described above, the sheet feeder 2 of the laser printer 1 according to the embodiment uses the sheet presence or absence detection sensor 24 and the upper surface detection sensor 26 to determine the stacking amount of the sheets S on the stacking tray 20. Therefore, a remaining amount detection sensor for detecting the remaining amount of the sheets S used for determining the stacking amount of the sheets S can be eliminated, which enables cost reduction of the sheet feeder 2. As a result, cost reduction of the entire laser printer 1 can be attained. Further, space for the remaining amount detection sensor may be eliminated, which enables downsizing of the sheet feeder 2. Therefore, downsizing of the entire laser printer 1 can be attained.

Further, the stacking amount determining portion 11*d* according to the embodiment uses the stacking amount determination map in which the relationship between difference in time and stacking amount is recorded in advance to determine the stacking amount of the sheets S. Therefore, the stacking amount of the sheets S can be determined easily.

Further, the sheet feeder 2 according to the embodiment determines the stacking amount based on the difference in time between the timing at which the sheet presence or absence detection sensor 24 detects the sheets S and the timing at which the upper surface detection sensor 26 detects the sheets. In other words, the start timing to measure the difference in time is the timing at which the sheet presence or absence detection sensor 24 detects the sheets S. Therefore, it is not necessary to take into consideration, for example, a time-lag which may be caused in initial operation of rotating the intermediate plate 21. Accordingly, accurate difference in time can be obtained, and as a result, the stacking amount can be accurately determined.

An embodiment of the present invention is described in the above, but the present invention is not limited to the above-mentioned embodiment. Further, the effects described in the embodiment of the present invention are only recited as most preferred effects of the present invention, and the effects of the present invention are not limited to those described in the embodiment of the present invention.

For example, in the embodiment, the stacking amount determining portion 11*d* uses the stacking amount determination map to determine the sheet stacking amount, but the present invention is not limited thereto. For example, the stacking amount determining portion 11*d* may compute and determine the stacking amount in accordance with the difference in time.

While the present invention has been described with reference to exemplary embodiments, it is to be understood that the invention is not limited to the disclosed exemplary embodiments. The scope of the claims is to be accorded the broadest interpretation so as to encompass all such modifications and equivalent structures and functions.

This application claims the benefit of Japanese Patent Application No. 2012-044512, filed Feb. 29, 2012, which is hereby incorporated by reference herein in its entirety.

What is claimed is:

1. A sheet feeder, comprising:

a stacking member on which sheets are stacked;

a feeding member configured to feed an uppermost sheet of the sheets on the stacking member;

a driving unit configured to upwardly rotate the stacking member so that an end of the stacking member on a downstream side in a sheet feeding direction moves upwardly;

a first detection unit configured to detect the sheets on the stacking member at a first detection position while the driving unit upwardly rotates the stacking member;

a second detection unit configured to detect the sheets on the stacking member at a second detection position, wherein, while the driving unit upwardly rotates the stacking member, the first detection unit detects the sheets after the second detection unit detects the sheets; and a stacking amount determining unit configured to determine a stacking amount of the sheets on the stacking member, based on a period of time from a time when the second detection unit detects the sheets to a time when the first detection unit detects the sheets while the driving unit upwardly rotates the stacking member, wherein the first detection position and the second detection position are set so that a rotation angle of the stacking member rotating from a position where the second detection unit detects the sheets to a position where the first detection unit detects the sheets in a case that the stacking amount is a first amount, is less than a rotation angle of the stacking member in a case that the stacking amount is a second amount which is greater than the first amount.

2. A sheet feeder according to claim 1, wherein the second detection unit is a sheet presence or absence detection unit which detects a presence or absence of the sheets on the stacking member.

3. A sheet feeder according to claim 1, wherein the stacking amount determining unit has a memory that stores a data according to the relationship between the period of time from the time when the second detection unit detects the sheets to the time when the first detection unit detects the sheets and the stacking amount of the sheets, and determines the stacking amount of the sheets based on the data stored in the memory.

4. A sheet feeder according to claim 1, further comprising a display portion which displays the stacking amount of the sheets determined by the stacking amount determining unit.

5. A sheet feeder according to claim 1, wherein the second detection unit is located upstream of the first detection position in the sheet feeding direction and below the first detection position.

6. A sheet feeder according to claim 1, wherein the first detection unit is an upper surface detection unit which detects a position of the upper surface of the sheets on the stacking member.

7. A sheet feeder according to claim 1, wherein the first detection unit includes a first moving member which is moved by contact with the sheets on the stacking member, and a first sensor detecting the first moving member.

8. A sheet feeder according to claim 1, wherein the second detection unit includes a second moving member which is moved by contact with the sheets on the stacking member, and a second sensor detecting the second moving member.

9. A sheet feeder according to claim 1, wherein the period of time in a case that the stacking amount is the first amount, is shorter than the period of time in a case that the stacking amount is the second amount.

10. A sheet feeder according to claim 1, wherein the feeding member has a roller which is rotated by coming into contact with the sheets.

11. A sheet feeder according to claim 1, wherein the feeding member is configured to feed the sheets on the stacking member one by one.

12. A sheet feeder, comprising:

a stacking member on which sheets are stacked;

a feeding member configured to feed an uppermost sheet of the sheets on the stacking member;

a driving unit configured to upwardly rotate the stacking member so that an end of the stacking member on a downstream side in a sheet feeding direction moves upwardly;

a first detection unit configured to detect the sheets on the stacking member at a first detection position while the driving unit upwardly rotates the stacking member;

a second detection unit configured to detect the sheets on the stacking member at a second detection position, wherein, while the driving unit upwardly rotates the stacking member, the first detection unit detects the sheets after the second detection unit detects the sheets; and a stacking amount determining unit configured to determine a stacking amount of the sheets on the stacking member, based on a timing when the second detection unit detects the sheets and a timing when the first detection unit detects the sheets while the driving unit upwardly rotates the stacking member, wherein the first detection position and the second detection position are set so that a rotation angle of the stacking member rotating from a position where the second detection unit detects the sheets to a position where the first detection unit detects the sheets in a case that the stacking amount is a first amount, is less than a rotation angle of the stacking member in a case that the stacking amount is a second amount which is greater than the first amount.

13. A sheet feeder according to claim 12, wherein the second detection unit is located upstream of the first detection position in the sheet feeding direction and below the first detection position.

* * * * *